US006032008A

United States Patent [19]

Kolodziej

[11] Patent Number: 6,032,008

[45] Date of Patent: Feb. 29, 2000

[54] PHOTOCONDUCTOR WEAR REDUCTION

[75] Inventor: Ryan H. Kolodziej, Nampa, Id.

[73] Assignee: Hewlett-Packard Company, Palo Alto, Calif.

[21] Appl. No.: 09/044,071

[22] Filed: Mar. 16, 1998

[51] Int. Cl.[7] ..... G03G 15/00

[52] U.S. Cl. ..... 399/167; 399/75

[58] Field of Search ..... 399/167, 75, 159, 399/45, 26, 88, 37

[56] References Cited

U.S. PATENT DOCUMENTS

| | | | |
|---|---|---|---|
| 4,477,180 | 10/1984 | Bustamante | 399/26 X |
| 4,522,483 | 6/1985 | Matsumoto et al. | 399/167 |
| 4,719,491 | 1/1988 | Katoh et al. | 399/75 |
| 5,294,958 | 3/1994 | Isobe et al. | 399/46 |

*Primary Examiner*—Sophia S. Chen
*Attorney, Agent, or Firm*—Gregg W. Wisdom

[57] ABSTRACT

A photoconductor wear reduction system includes a photoconductor drum clutch and a control circuit for controlling the clutch. Wear on the photoconductor drum is reduced by mechanically decoupling the photoconductor drum from the drive train in the electrophotographic printer at the end of a print job while the drive train is still rotating. In a first embodiment of the photoconductor drum clutch, the application of electrical power is required to mechanically couple the photoconductor drum to the drive. In the second and third embodiments of the photoconductor drum clutch, the photoconductor drum clutch mechanically couples the photoconductor drum to the drive train without electrical power applied. The application of power to the photoconductor drum clutch is required to mechanically decouple the photoconductor drum from the drive train. Because the length of time during a print job that the photoconductor drum must be mechanically coupled to the drive train is typically significantly greater than the length of time that the photoconductor drum can be mechanically decoupled from the drive train to reduce wear, using the second or the third embodiment of the photoconductor drum clutch provides an energy savings over the first embodiment. Furthermore, a photoconductor drum clutch that does not require electrical power to mechanically couple the photoconductor drum to the drive train permits the use of a battery to power the photoconductor drum clutch because, in the event of the loss of battery power, the photoconductor drum is still useable.

18 Claims, 7 Drawing Sheets

PHOTOCONDUCTOR WEAR REDUCTION

FIELD OF THE INVENTION

This invention relates to electrophotographic printing systems, and more particularly to an apparatus which reduces the wear on the photoconductor drum used in the electrophotographic printing system.

BACKGROUND OF THE INVENTION

In many electrophotographic printing systems, such as electrophotographic printers or electrophotographic copiers, a photoconductor drum is used for generating a latent electrostatic image onto which toner is subsequently developed. During the printing process, the surface of the photoconductor drum contacts print media and other components of the electrophotographic printing system, such as a transfer roller, during rotation. The contact from the printing process results in wear on the surface of the photoconductor drum. The resulting wear limits the useful life of the photoconductor drum.

Typically, in electrophotographic printing systems, the print media passes between the rotating photoconductor drum and the transfer roller or a backup roller. Generally, in electrophotographic printing systems, after the trailing edge of the last sheet of print media in the print job has passed out of the nip region between the photoconductor drum and the transfer roller or backup roller, the photoconductor drum undergoes several post print media rotations. These post print media rotations contribute to the wear on the photoconductor drum.

For the case in which printing is done primarily on single page jobs, the resulting rate of wear is much greater than for multi-page jobs because the number of post rotations per page is considerably higher than for multiple page jobs. Consider, for example, an electrophotographic printer. In electrophotographic printers, the photoconductor drum is typically gear driven as part of a gear train which drives rollers used in all parts of the print media path. The gear train must continue to rotate after the print media has moved beyond the photoconductor drum to move the print media through the remainder of the steps in the electrophotographic printing process and to the output tray. Therefore, as the print media moves toward the output tray after passing the photoconductor drum, the photoconductor drum continues to rotate. These additional rotations cause unnecessary wear on the surface of the photoconductor drum, thereby needlessly shortening the useful life of the photoconductor drum.

For electrophotographic printers with print media paths which are long relative to the dimension of the print media parallel to the direction of movement of print media through the print media path, the reduction in the useful life of the photoconductor drum is especially severe. The reduction in useful life of the photoconductor drum is especially severe for the case in which the predominant use of the printer is for the printing of single page jobs, because many more rotations of the photoconductor drum occur than would have occurred if the same number of pages had been printed using multiple page print jobs. In some electrophotographic printers having relatively long print media paths, printing single page jobs requires three times as many rotations of the photoconductor drum as are required for transfer of the developed image onto the print media.

In some electrophotographic printers for which the print media path is not long relative to the dimension of the print media parallel to the direction of movement of print media through the print media path, the reduction in the useful life of the photoconductor drum can still be substantial. In some electrophotographic printers of this type, the control of the gear train which rotates the photoconductor drum is done with the default assumption that the print media which moves through the print media path is always the longest type of print media which the printer can handle. By designing the printer so that the printer performs as if all print media is of the longest type, the necessity of detecting the end of the page is eliminated, thereby reducing the cost of the printer. In these types of printers, even though the print media path of the printer is relatively short, single page jobs of letter size print media can still result in significant amounts of unnecessary wear. The unnecessary wear results from the incremental number of rotations of the photoconductor drum required from the default treatment of the print media as the longest possible type of print media.

Electrophotographic printers using a clutch to disconnect the photoconductor drum from the drive train of the electrophotographic printer have been disclosed in the prior art. In the disclosed implementations, the means used to disconnect the drive train of the electrophotographic printer from the photoconductor drum is part of the drive train of the electrophotographic printer. However, designing the means to disconnect the photoconductor drum from the drive train as part of the drive train places a limitation upon the ability to retrofit this capability into electrophotographic printers in the possession of customers. For some electrophotographic printers there may be a desire to implement the capability to reduce wear upon the photoconductor drum in electrophotographic printers already in the possession of customers. By including the means to disconnect the drive train within the drive train, implementing this capability would, in many cases, be prohibitively expensive. A need exists for an apparatus to permit the disconnecting of the photoconductor drum from the printer drive train that can be inexpensively retrofitted into field printers.

SUMMARY OF THE INVENTION

Accordingly, a photoconductor wear reduction system for use in an electrophotographic printing system provides the capability to mechanically decouple a photoconductor from the electrophotographic printing system drive train. The photoconductor wear reduction system includes a photoconductor and a clutch attached to the photoconductor. The photoconductor wear reduction system further includes a control circuit coupled to the clutch and the electrophotographic printing system. The control circuit controls actuation of the clutch so that the photoconductor is mechanically decoupled from the drive train after the last unit of print media of the print job has moved past the photoconductor and while the drive train is still in motion.

An electrophotographic printing system includes a photoconductor and a clutch attached to the photoconductor. A control circuit coupled to the clutch and the electrophotographic printing system is used for actuating the clutch. The clutch is used for selectively mechanically coupling the photoconductor to a drive train included in the electrophotographic printing system so that the photoconductor is mechanically decoupled from the drive train after the last unit of print media of the print job has moved past the photoconductor and while the drive train is still in motion.

In an electrophotographic printing system for printing upon print media with the electrophotographic printing system including a photoconductor, a clutch attached to the photoconductor, a drive train, and a control circuit coupled to the clutch, a method for reducing wear on the photoconductor includes the steps of determining when the last unit of print media in a print job has passed the photoconductor using the control circuit and then decoupling the photoconductor from the drive train by actuating the clutch.

DESCRIPTION OF THE DRAWINGS

A more thorough understanding of the invention may be had from the consideration of the following detailed description taken in conjunction with the accompanying drawings in which.

DETAILED DESCRIPTION OF THE DRAWINGS

The present invention is not limited to the specific exemplary embodiments illustrated herein. Although the description of the preferred embodiment of the photoconductor wear reduction system will be provided in the context of a photoconductor drum for an electrophotographic printer, one of ordinary skill in the art will recognize from understanding this disclosure that the photoconductor wear reduction system is applicable for the reduction in wear of photoconductor drums in other electrophotographic printing systems such as electrophotographic copiers. Furthermore, it should be recognized that although the reduction of wear will be discussed in the context of a photoconductor drum, the use of a photoconductor wear reduction system is also applicable for the reduction of wear in electrophotographic printing systems using photoconductor belts. Additionally, a photoconductor wear reduction system would be useful for any electrophotographic component located within the print media path which undergoes "unnecessary" rotations as the print media moves through the print media path.

Figure 1:
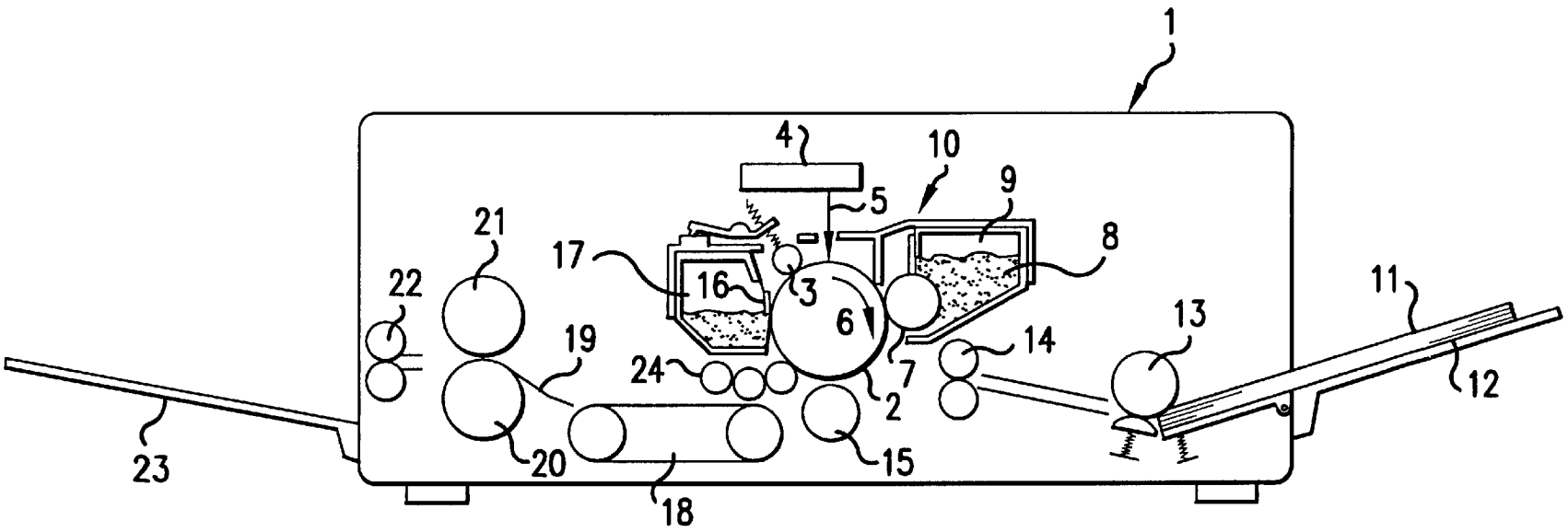
FIG. 1 shows a simplified cross sectional view of an electrophotographic printer.

Referring to FIG. 1, shown is a simplified cross sectional view of an exemplary electrophotographic printer 1 containing a photoconductor drum 2 (using an embodiment of the photoconductor drum clutch which, however, is not illustrated in FIG. 1) for the purposes of describing the electrophotographic printing process. Charge roller 3 is used to charge the surface of photoconductor drum 2 to a predetermined voltage. A laser diode (not shown) inside laser scanner 4 emits a laser beam 5 which is pulsed on and off as it is swept across the surface of photoconductor drum 2 to selectively discharge the surface of the photoconductor drum 2. Photoconductor drum 2 rotates in the clockwise direction as shown by the arrow 6. Developer roller 7 is used to develop the latent electrostatic image residing on the surface of photoconductor drum 2 after the surface voltage of the photoconductor drum 2 has been selectively discharged. Toner 8 which is stored in the toner hopper 9 of electrophotographic print cartridge 10 moves from locations within the toner hopper 9 to the developer roller 7. The magnet located within the developer roller 7 magnetically attracts the toner 8 to the surface of the developer roller 7. As the developer roller 7 rotates in the counterclockwise direction, the toner on the surface of the developer roller 7, located opposite the areas on the surface of photoconductor drum 2 which are discharged, is moved across the gap between the surface of the photoconductor drum 2 and the surface of the developer roller 7 to develop the latent electrostatic image.

Print media 11 is loaded from paper tray 12 by pickup roller 13 into the paper path of the electrophotographic printer 1. Print media 11 moves through the drive rollers 14 so that the arrival of the leading edge of print media 11 below photoconductor drum 2 is synchronized with the rotation of the region on the surface of photoconductor drum 2 having a latent electrostatic image corresponding to the leading edge of print media 11. As the photoconductor drum 2 continues to rotate in the clockwise direction, the surface of the photoconductor drum 2, having toner 8 adhered to it in the discharged areas, contacts the print media 11 which has been charged by transfer roller 15 so that it attracts the toner particles away from the surface of the photoconductor drum 2 and onto the surface of the print media 11. The transfer of toner particles from the surface of photoconductor drum 2 to the surface of the print media 11 does not occur with one hundred percent efficiency and therefore some toner particles remain on the surface of photoconductor drum 2. As photoconductor drum 2 continues to rotate, toner particles which remain adhered to its surface are removed by cleaning blade 16 and deposited in toner waste hopper 17.

As the print media 11 moves in the paper path past photoconductor drum 2, conveyer belt 18 delivers the print media 11 up inlet guide 19 to fuser 20. The print media 11 passes between the fuser 20 and the pressure roller 21. Pressure roller 21 provides the drive force to pull print media 11 over fuser 20 and forces print media 11 against the surface of fuser 20. Fuser 20 applies heat to print media 11 so that the toner particles are fused to the surface of print media 11. Output rollers 22 push the print media 11 into the output tray 23 after exiting the fusing operation. Drive train 24, a part of which is shown in FIG. 1, is used for driving photoconductor drum 2, as well as the other rotating assemblies in electrophotographic printer 1. Further details on electrophotographic processes can be found in the text "The Physics and Technology of Xerographic Processes", by Edgar M. Williams, 1984, a Wiley-Interscience Publication of John Wiley & Sons, the disclosure of which is incorporated by reference herein.

An implementation of the photoconductor wear reduction system includes a mechanical means to connect and disconnect the electrophotographic printer drive train to and from the photoconductor drum. The electrophotographic printer drive train includes the gears used to deliver mechanical power from the stepper motor to the various rotating assemblies within the electrophotographic printer such as the photoconductor drum, the fuser, and print media drive rollers. In addition, the photoconductor wear reduction system must be able to detect the presence or absence of print media to control the connection and disconnection of the photoconductor drum to the drive train. The capability to detect the presence and absence of print media could be included as part of the photoconductor wear reduction system or could exist external to it.

Figure 2:
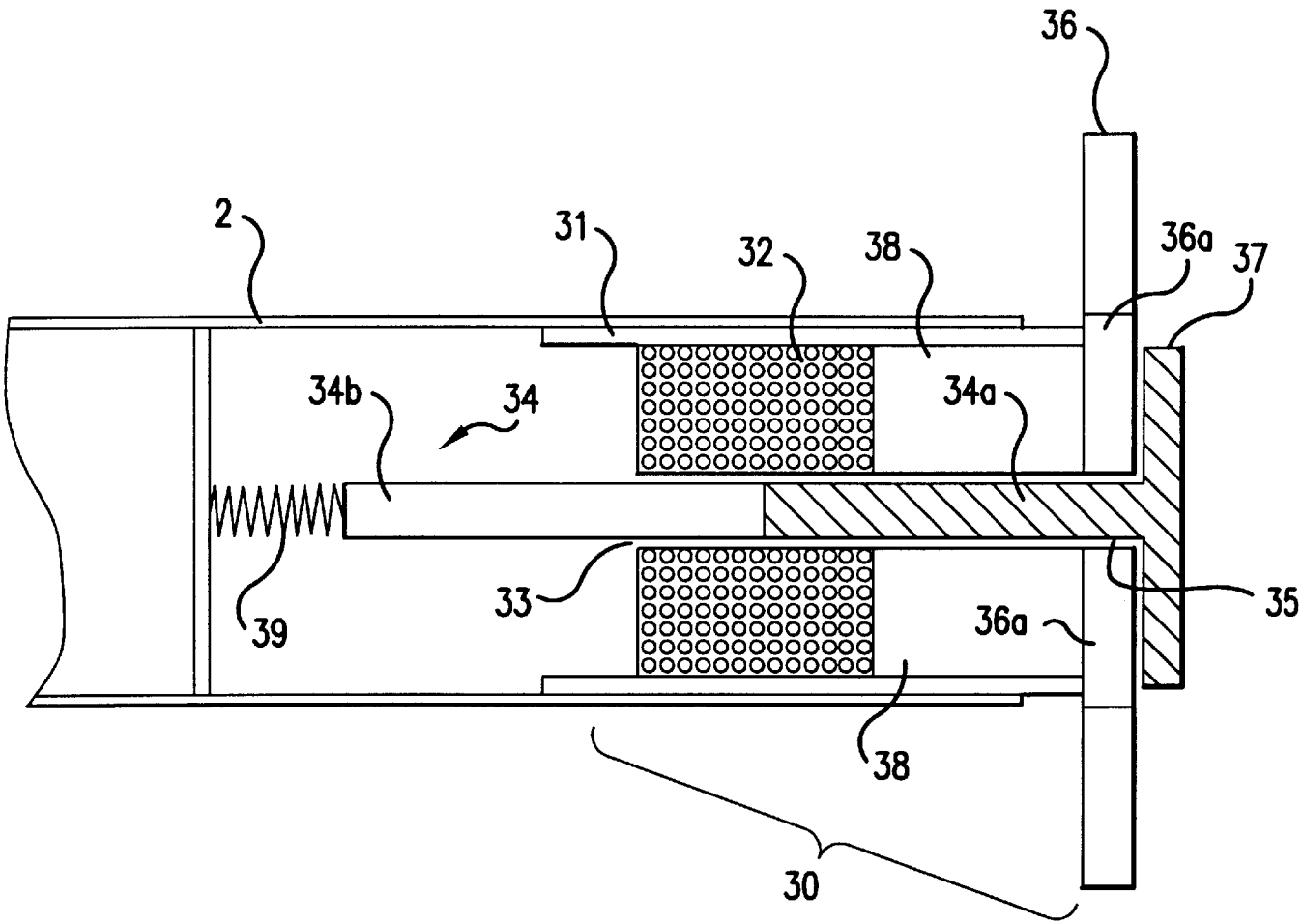
FIG. 2 shows a cross sectional view of a first embodiment of a photoconductor drum clutch.

Shown in FIG. 2 is a cross sectional view showing a first embodiment of a photoconductor drum clutch 30 that could be used in the photoconductor wear reduction system. The photoconductor drum clutch 30 includes a flange 31 for fitting on the inner surface of photoconductor drum 2. The flange 31 forms an interference fit to the inner surface of photoconductor drum 2 or, alternatively, the flange 31 can be glued to the inner surface of photoconductor drum 2. Attached to the flange 31 is an electrical coil 32. The flange 31 may be integrally formed as part of the electrical coil 32 or attached to electrical coil 32 by, for example, spot welding. The electrical coil 32 includes a hole 33. A shaft 34 is inserted through hole 33. Shaft 34 is also inserted through a hole 35 in gear 36. Shaft 34 includes a metal portion 34*a* and a nonmetallic portion 34*b*. Gear 36 meshes with a gear in the electrophotographic printer drive train. Gear 36 is formed of an annular ring of rigid material, such as a thermo-plastic, having gear teeth. The inner portion 36*a* of gear 36 is formed from a material such as rubber which permits a high friction contact between inner portion 36*a* and plastic piece 38 and the inner portion 36*a* and clutch plate 37. A clutch plate 37 is attached to shaft 34 so that gear 36 is located between electrical coil 32 and clutch plate 37.

Application of electrical power to electrical coil 32 pulls clutch plate 37 against inner portion 36*a* of gear 36, causing gear 36 to become compressed between plastic piece 38 and clutch plate 37. The material forming the inner portion 36*a* of gear 36 causes mechanical coupling between plastic piece 38 and gear 36 so that photoconductor drum 2 is mechanically coupled to the printer drive train. When no electrical power is applied to electrical coil 32, bias spring 39 forces shaft 34 to move out of photoconductor drum 2 so that clutch plate 37 is not compressed against the face of electrical coil 32, thereby mechanically decoupling photoconductor drum 2 from gear 36.

The first embodiment of the photoconductor drum clutch 30 requires the application of power to electrical coil 32 to mechanically couple photoconductor drum 2 to the electrophotographic printer drive train. For those implementations of the photoconductor wear reduction system which are designed to be self contained within an electrophotographic print cartridge, a potential difficulty is the power required to actuate the first embodiment of the photoconductor drum clutch 30. During the course of a print job, the photoconductor drum 2 must be mechanically coupled to the electrophotographic printer drive train for a large percentage of the time required to process the print job. To accomplish this, electrical power must be supplied to electrical coil 32 for a large percentage of the time required to process the print job. Because of this, the first embodiment of the photoconductor drum clutch 30 is not as power efficient as would be a photoconductor drum clutch embodiment for which power need only be applied during the period time near the end of the print job when the photoconductor drum 2 is decoupled from the electrophotographic printer drive train to prevent necessary wear on photoconductor drum 2. A more power efficient implementation of a photoconductor drum clutch would lower the cost of a self contained photoconductor wear reduction system within an electrophotographic print cartridge.

Figure 3:
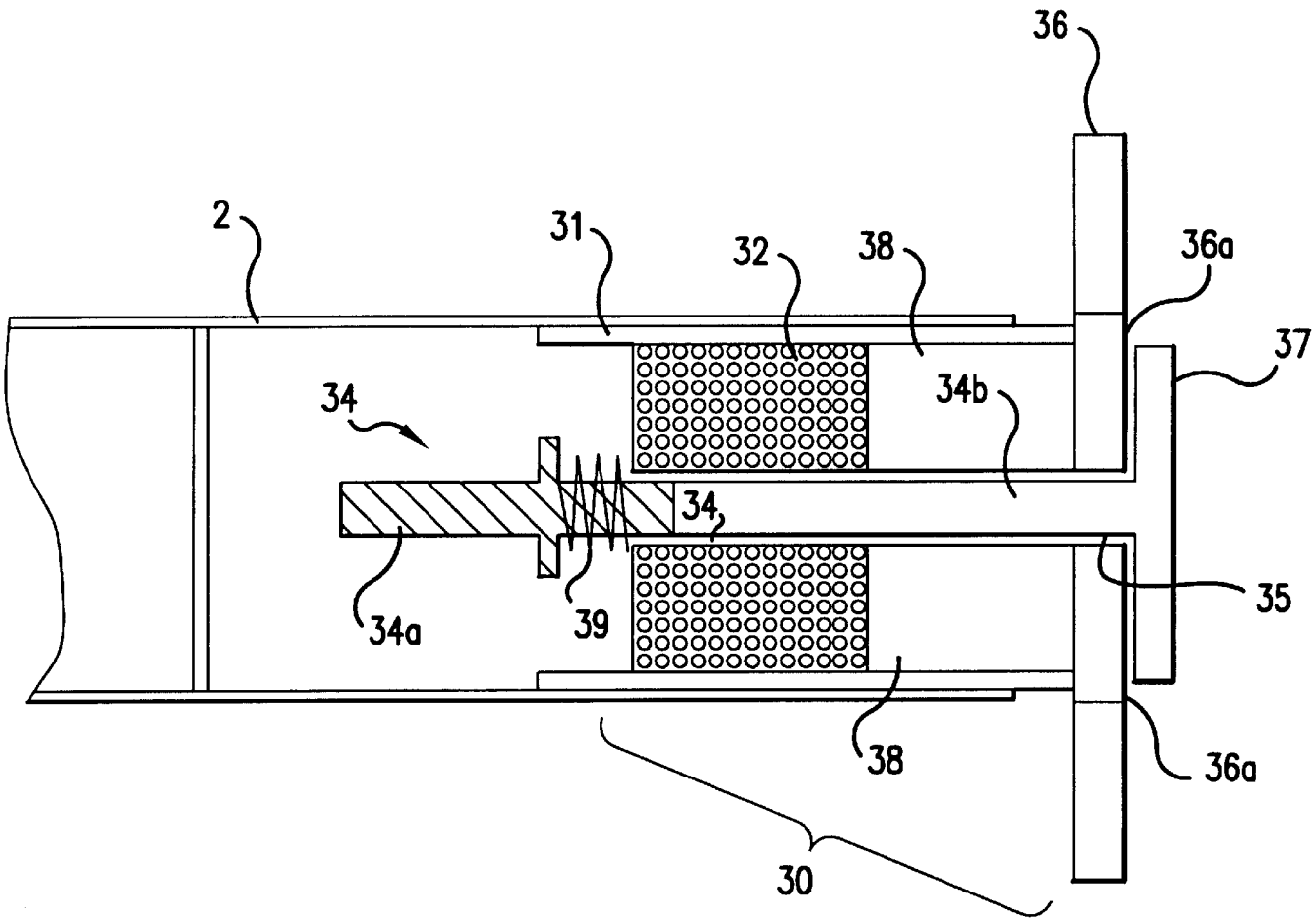
FIG. 3 shows a cross sectional view of a second embodiment of a photoconductor drum clutch.

Shown in FIG. 3 is a cross sectional view of a second embodiment of photoconductor drum clutch 30 that could be used in the photoconductor wear reduction system. This second embodiment of photoconductor drum clutch 30 is structurally closely related to the first embodiment. However, the key difference is that the second embodiment of photoconductor drum clutch 30 mechanically couples photoconductor drum 2 to the electrophotographic printer drive train without electrical power applied. The second embodiment of photoconductor drum clutch 30 includes a flange 31 for fitting on the inner surface of photoconductor drum 2. The flange 31 forms an interference fit to the inner surface of photoconductor drum 2 or, alternatively, the flange 31 can be glued to the inner surface of photoconductor drum 2. Attached to the flange 31 is an electrical coil 32. The flange 31 may be integrally formed as part of the electrical coil 32 or attached to electrical coil 32 by, for example, spot welding. The electrical coil 32 includes a hole 33. Shaft 34 is inserted through hole 33. Shaft 34 is also inserted through a hole 35 in gear 36. Shaft 34 includes a metal portion 34*a* and a nonmetallic portion 34*b*. Gear 36 meshes with a gear in the electrophotographic printer drive train. Gear 36 is formed of an annular ring of rigid material, such as a thermo-plastic, having gear teeth. The inner portion 36*a* of gear 36 is formed from a material such as rubber which permits high friction contact between inner portion 36*a* and plastic piece 38 and the inner portion 36*a* and clutch plate 37. A clutch plate 37 is attached to shaft 34 so that gear 36 is located between electrical coil 32 and clutch plate 37.

Without electrical power applied to electrical coil 32, clutch plate 37 is pulled against inner portion 36*a* of gear 36, causing gear 36 to become compressed between plastic piece 38 and clutch plate 37. The force which compresses gear 36 between plastic piece 38 and clutch plate 37 is supplied by bias spring 39. This compression causes mechanical coupling between plastic piece 38 and gear 36 so that photoconductor drum 2 is mechanically coupled to the printer drive train. The position of bias spring 39 on the second embodiment of photoconductor drum clutch 30 permits mechanical coupling between photoconductor drum 2 and the electrophotographic printer drive train without having power applied to electrical coil 32. When electrical power is applied to electrical coil 32, the resulting magnetic field pulls the metal portion 34*a* of shaft 34 toward electrical coil 32 so that bias spring 39 is compressed. This movement of shaft 34 causes clutch plate 37 to break contact with gear 36, thereby mechanically decoupling photoconductor drum 2 from the electrophotographic printer drive train.

Figure 4:
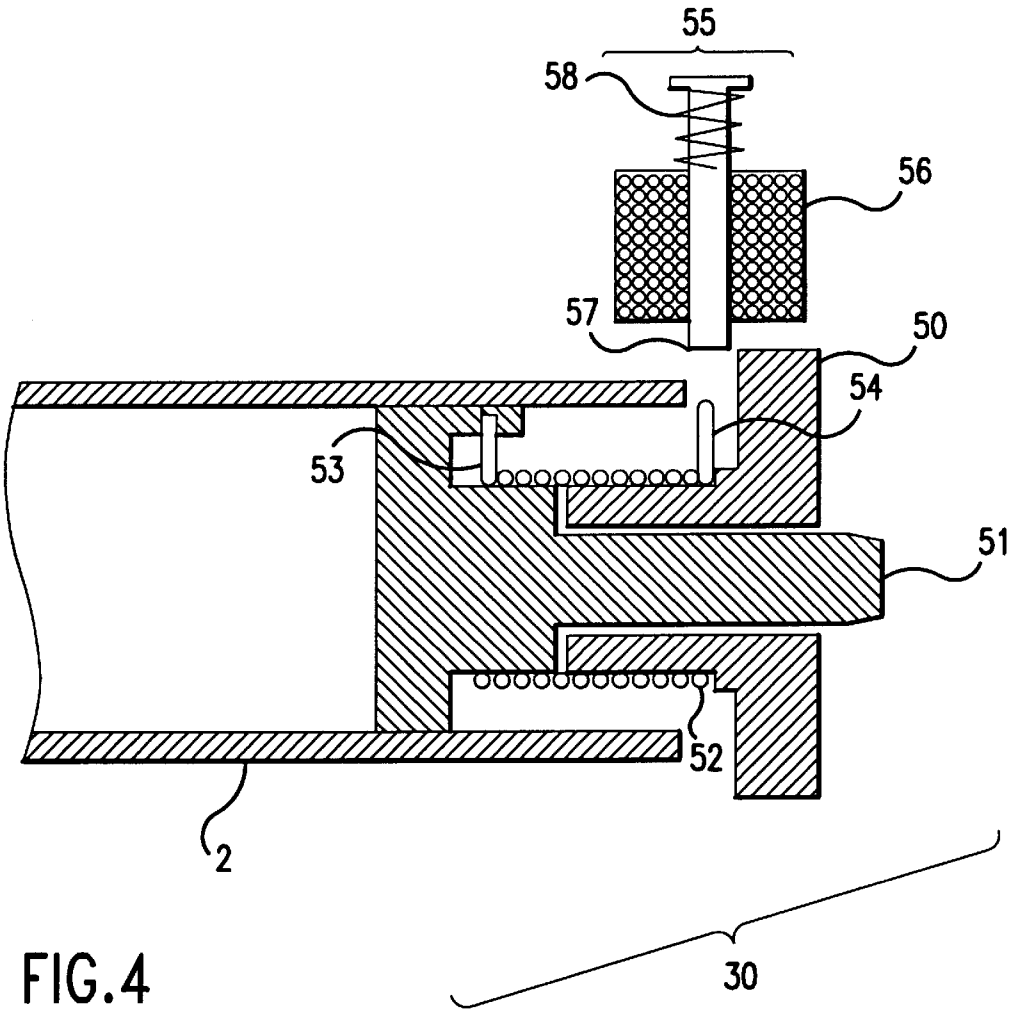
FIG. 4 shows a cross sectional view of a third embodiment of a photoconductor drum clutch.

A third, and preferred, embodiment of photoconductor drum clutch 30 is shown in FIG. 4. This embodiment of photoconductor drum clutch 30 is preferred because of its relatively low power consumption. The second embodiment of photoconductor drum clutch 30 requires substantially less power than the first embodiment. The third embodiment of the photoconductor drum clutch 30 requires even less power than the second embodiment. The third embodiment of photoconductor drum clutch 30 includes a gear 50 with a hole into which drum hub 51 is inserted. Gear 50 meshes with a gear in the drive train of electrophotographic printer 1. Part of drum hub 51 located inside of photoconductor drum 2 is inserted into a coil spring 52. A shank of gear 50 is also inserted into coil spring 52. Coil spring 52 includes a first tang 53, which is inserted into a notch in drum hub 51 as shown in FIG. 4, and a second tang 54. With first tang 53 inserted into the notch in drum hub 51, one end of coil spring 52 is held in place. Solenoid 55 includes an electrical coil 56 and a solenoid plunger 57. With no power applied to electrical coil 56, bias spring 58 pushes solenoid plunger 57 out of electrical coil 56 so that solenoid plunger 57 does not engage second tang 54. Without solenoid plunger 57 engaging second tang 54, coil spring 52 mechanically couples drum hub 51 to gear 50, thereby mechanically coupling photoconductor drum 2 to the electrophotographic printer drive train.

The third embodiment of photoconductor drum clutch 30 is designed so that without power applied to electrical coil 56, photoconductor drum 2 is mechanically coupled to the electrophotographic printer drive train. Mechanically decoupling photoconductor drum 2 from the drive train requires the application of power to electrical coil 56. Application of power to electrical coil 56 moves solenoid plunger 57 into a position engaging second tang 54. The coils of coil spring 52 are wound in such a direction around drum hub 51 and gear 50 so that when solenoid plunger 57 engages second tang 54, the coils of coil spring 52 are unwound, thereby mechanically decoupling drum hub 51 from gear 50.

Included within the photoconductor wear reduction system are the control electronics necessary to disengage the photoconductor drum 2 from the electrophotographic printer drive train after the trailing edge of the last unit of print media 11 of the print job has moved beyond the photoconductor drum 2 in the print media path. For the second and third embodiments of the photoconductor drum clutch 30 to mechanically decouple the photoconductor drum 2 from the electrophotographic printer drive train, electrical power must be supplied to the electrical coil 32 or electrical coil 56 after the trailing edge of print media 11 passes photoconductor drum 2. The photoconductor drum 2 must be disengaged from the electrophotographic printer drive train only for the period of time that the drive train is still rotating after the trailing edge of the print media 11 has passed photoconductor drum 2. As soon as the electrophotographic printer drive train ceases rotation, the supply of electrical power to electrical coil 32 or electrical coil 56 can be terminated, thereby allowing the photoconductor drum 2 to be mechanically coupled to gear 36 or gear 50.

The photoconductor wear reduction system includes a light source and a photo detector. To decouple the photoconductor drum 2 from the drive train of the electrophotographic printer at the proper time, there must be some way in which to determine that print media 11, in its movement through the print media path, has passed by photoconductor drum 2. In the preferred embodiment of the photoconductor wear reduction system, a photo detector is used to detect the presence of the print media in advance of the photoconductor drum 2. The photo detector measures the light reflected from a light source illuminating the surface of print media 11 located adjacent to electrophotographic print cartridge 10 to generate a signal. This signal is used, along with a signal derived from the AC bias applied to the charge roller 3, to control the operation of photoconductor drum clutch 30.

Figure 5:
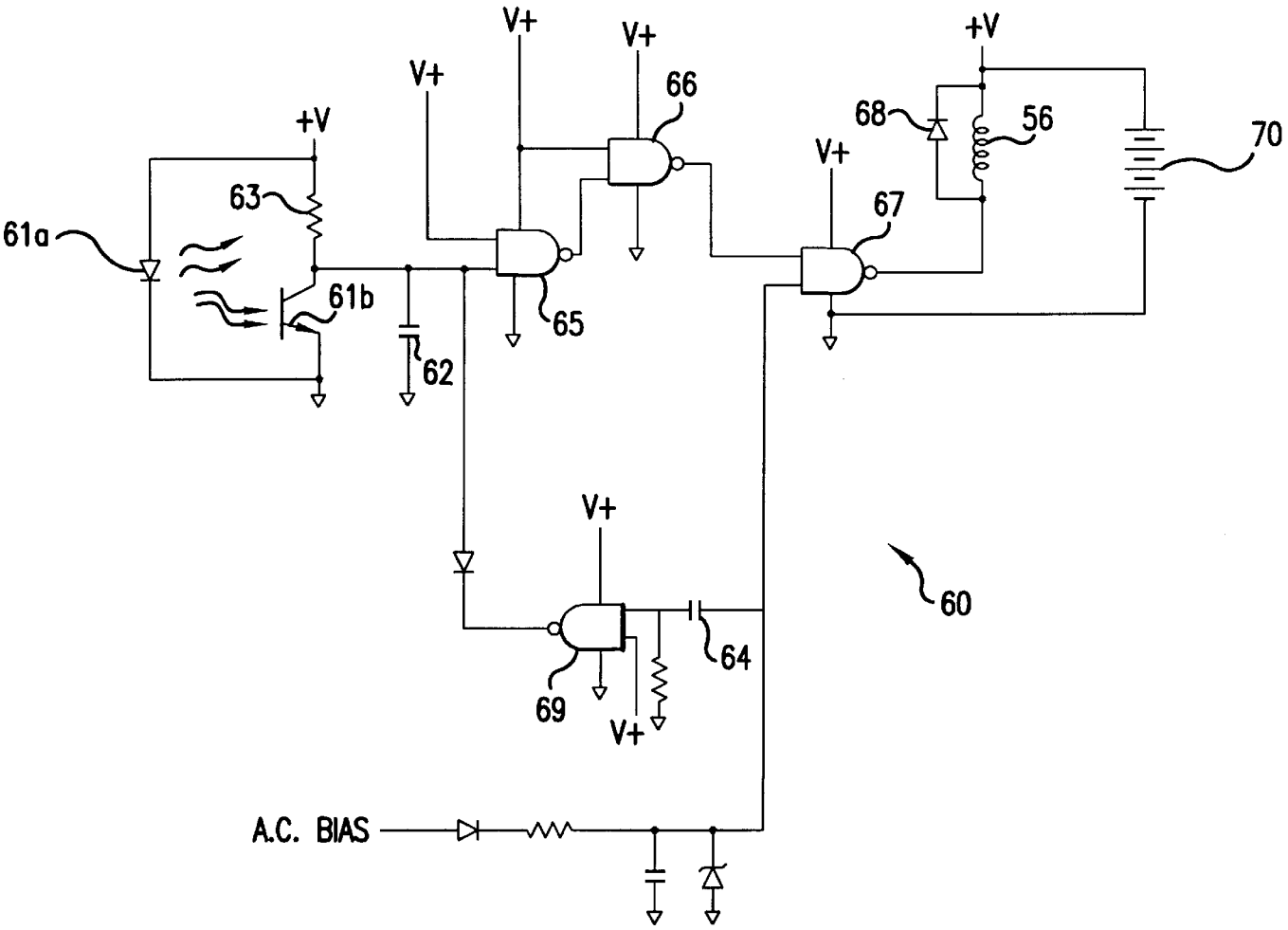
FIG. 5 shows a schematic of an embodiment of a control circuit that could be used to control the operation of the photoconductor drum clutch.

Shown in FIG. 5 is an exemplary electronic circuit 60 that is useful for properly timing the application of power to either of the second or third embodiments of photoconductor drum clutch 30 to reduce the wear on the photoconductor. It should be recognized that it would be possible to use a number of different circuits to achieve the needed control of the photoconductor drum clutch 30. For example, a circuit using 555 timers configured as one shots triggered from a photo detector, used to detect the presence of print media, and triggered by the AC bias supplied to the charge roller could generate the control signals required to properly actuate photoconductor drum clutch 30.

The circuit 60 of FIG. 5 uses a light emitting diode 61*a* and a photo detector 61*b* to detect the presence or absence of print media 11 in the print media path immediately prior to photoconductor drum 2. The output of photo detector 61*b* is conditioned for use as a logic signal to control the actuation of photoconductor drum clutch 30. Additionally, the circuit of FIG. 5 is coupled to the AC bias supplied to charge roller 3. The AC bias supplied to charge roller 3 is rectified, attenuated, and filtered for use as a logic signal to control the actuation of photoconductor drum clutch 30.

Electrophotographic printer 1 controls the movement of print media 11 through the print media path and controls the application of AC bias to charge roller 3. The application of AC bias to the charge roller 3 indicates that print media 11 will soon arrive at photoconductor 2. For multiple page print jobs, AC bias supplied by electrophotographic printer 1 is typically turned off between pages and is of course turned off shortly after completion of the print job. The essential performance characteristic of circuit 60 is that it controls photoconductor drum clutch 30 so that the electrophotographic printer drive train is mechanically decoupled from photoconductor drum 2 for a short period of time at the completion of the print job when print media 11 has passed photoconductor drum 2 in the print media path and while the electrophotographic printer drive train is still in motion. Controlling photoconductor drum clutch 30 in this manner minimizes wear on photoconductor drum 2 while minimizing the energy necessary to accomplish the wear reduction.

Figure 6:
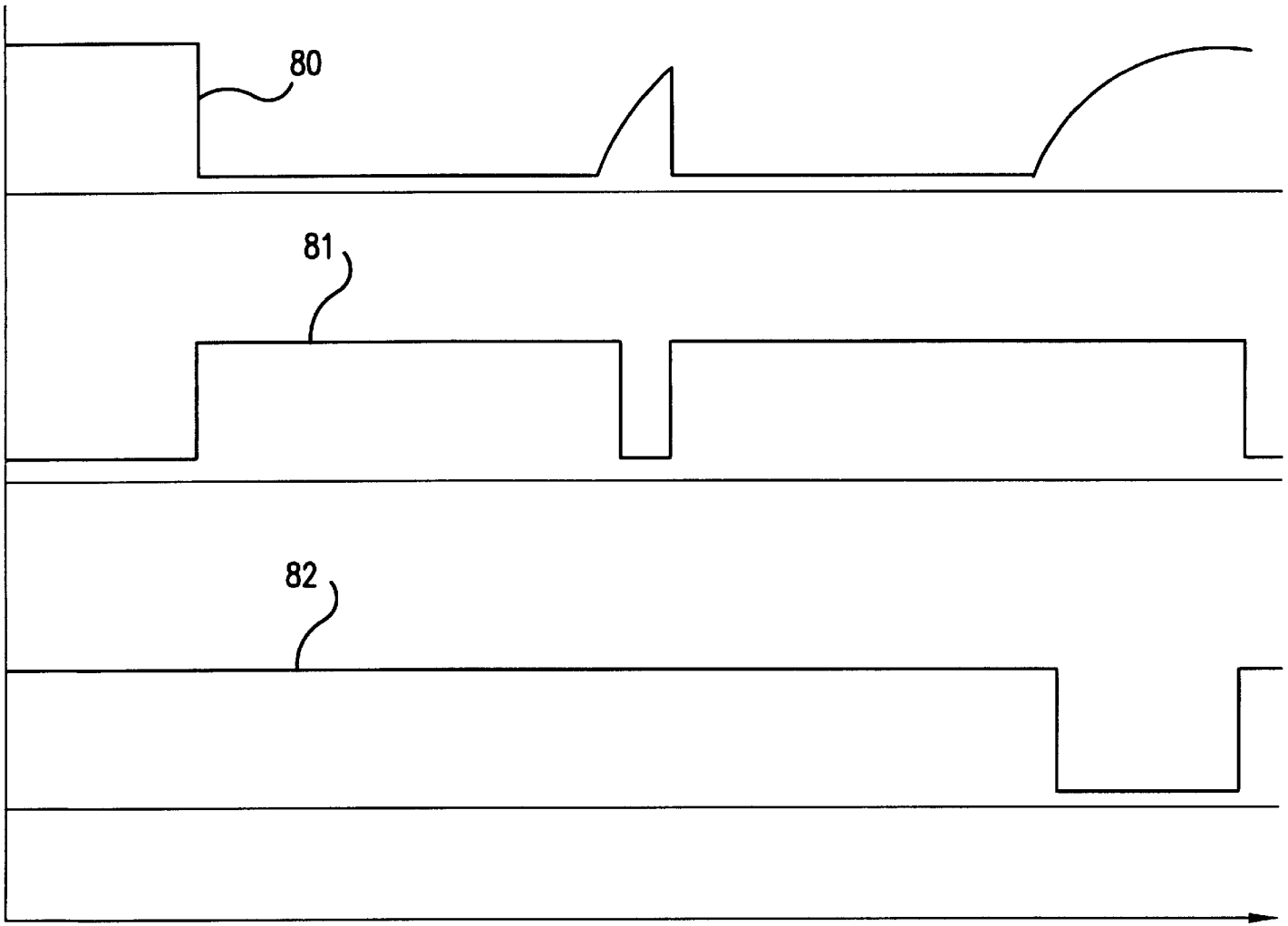
FIG. 6 is timing diagram showing the timing relationship of signals related to the operation of the control circuit.

Shown in FIG. 6 is a timing diagram that illustrates the relationship between the conditioned paper detect signal 80, the conditioned AC bias signal 81, and the clutch drive signal 82. The circuit 60 of FIG. 5 includes a first capacitor 62 and a first resistor 63 that control the transient response of circuit 60 on the rising edge of the conditioned paper detect signal (when the conditioned paper detect signal is at a high level this indicates the absence of print media 11 at electrophotographic print cartridge 10). The value of first capacitor 62 and first resistor 63 are selected to provide the necessary delay so that during the inter-page gaps between successive units of print media 11 moving through the print media path, photoconductor drum clutch 30 does not mechanically decouple photoconductor drum 2 from the electrophotographic printer drive train. However, the delay is designed to be just sufficiently long to prevent the mechanical decoupling of photoconductor drum 2 from the electrophotographic printer drive train under the anticipated maximum time delay between successive units of print media 11. To minimize the wear on photoconductor drum 2 after completion of the print job, it is important that the time constant formed by first capacitor 62 and first resistor 63 is no longer than necessary to prevent decoupling of photoconductor drum clutch 30 during the inter-page gap. By optimizing the time constant formed by first capacitor 62 and first resistor 63, the minimal photoconductor drum wear and minimal energy usage by photoconductor drum clutch 30 can be achieved.

Immediately after the completion of the print job, paper is not present at electrophotographic print cartridge 10. Shortly after the last unit of print media 11 of the print job moves past photoconductor drum 2, electrophotographic printer 1 removes the AC bias from the charge roller 3. The AC bias is removed from charge roller 3 at approximately the same time that electrophotographic printer 1 stops driving the gear train. Therefore, the removal of the AC bias serves as an indicator of the time at which photoconductor drum 2 can be mechanically coupled to the electrophotographic printer drive train without incurring unnecessary wear on photoconductor drum 2. Various electrophotographic printers may have different signals available which indicate the time at which the electrophotographic printer stops driving the gear train. It should be recognized that, by using the appropriate signal conditioning electronics, these other signals may be used to control coupling of photoconductor drum 2 to the drive train of the electrophotographic printer.

When print media 11 is not present at electrophotographic print cartridge 10, the voltage on first capacitor 62 begins to rise at a rate controlled by first capacitor 62 and first resistor 63. After the voltage on first capacitor 62 increases and reaches the logic threshold of NAND gate 65, the output of NAND gate 65 assumes a low level. Consequently, the output of NAND gate 66 assumes a high level. At the time the output of NAND gate 66 first assumes a high level after the completion of a print job, the AC bias signal is still applied and therefore both inputs of NAND gate 67 are both at a high level. When that occurs, the output of NAND 67 assumes a low level and current flows through electrical coil 56, thereby actuating photoconductor drum clutch 30 so that photoconductor drum 2 is mechanically decoupled from the electrophotographic printer drive train. After removal of the AC bias to charge roller 3, the corresponding input of NAND gate 67 assumes a low level, thereby causing the output of NAND gate 67 to assume a high level. When the output of NAND gate 67 changes from a low level to a high level, the current in electrical coil 56 or electrical coil 32 decays to zero (after the energy stored in electrical coil 56 or electrical coil 32 is dissipated in diode 68) and photoconductor drum clutch 30 mechanically couples photoconductor drum 2 to the electrophotographic printer drive train.

When a print job is started, AC bias is applied to charge roller 3 prior to the time at which print media 11 moves through the print media path of electrophotographic printer 1 and arrives at electrophotographic print cartridge 10. The application of AC bias to charge roller 3 causes the corresponding input of NAND gate 69 to, for a short time, rise to a level exceeding the logic threshold, (by coupling the conditioned AC bias signal through third capacitor 64) thereby driving the output of NAND gate 69 to a low level. With the output of NAND gate 69 driven to a low level, first capacitor 62 is rapidly discharged thereby ensuring that photoconductor drum clutch 30 will mechanically couple photoconductor drum 2 to the electrophotographic printer drive train in preparation for printing upon print media 11.

Many types of electrophotographic printers use electrophotographic print cartridges containing the components of the electrophotographic print process which require the most frequent replacement as the result of wear. Photoconductor drum 2 is typically included as part of electrophotographic print cartridge 10 because it is one of the components which experiences a significant rate of wear. For an implementation of photoconductor drum clutch 30 in an electrophotographic print cartridge, the electrical power necessary to operate photoconductor drum clutch 30 is supplied from a battery 70 located within the electrophotographic cartridge. By designing the photoconductor drum clutch 30 so that it is mechanically coupled without having electrical power supplied to electrical coil 56 or electrical coil 32, the size of the battery 70 required to supply power to electrical coil 56 or electrical coil 32 is smaller than required for the first embodiment of the photoconductor drum clutch 30. This is possible in some types of electrophotographic printers because the time for which photoconductor drum clutch 30 must be mechanically uncoupled from the electrophotographic printer drive train at the end of the print job is a relatively small percentage of the time the photoconductor drum 2 must rotate to complete the print job.

It should be recognized that there is an important additional advantage that results from using a photoconductor drum clutch 30 that engages the electrophotographic printer drive train without the application of power. If the battery 70 is discharged before the toner in electrophotographic print cartridge 10 is consumed, the electrophotographic print cartridge 10 will remain useable. Designing the photoconductor wear reduction system in this manner permits a sizing of the battery 70 to extend the life of photoconductor drum 2 just sufficiently so that photoconductor drum 2 will be at the end of its useable life when the toner 9 in electrophotographic print cartridge 10 is consumed. Designing the photoconductor wear reduction system in this manner permits minimization of the battery size to achieve the greatest improvement in performance for the lowest incremental cost.

Including the photoconductor wear reduction system completely within electrophotographic print cartridge 10, provides a distinct advantage over electrophotographic print systems which include a clutch external to the photoconductor drum 2. By including the photoconductor wear reduction system within the photoconductor drum 2, the wear improvement advantages can be implemented so that they are backward compatible for electrophotographic printing systems which have already been delivered to customers. Had the photoconductor wear reduction system been implemented so that it was located external to the photoconductor drum 2 within electrophotographic printer 1, it would be much more difficult to implement this improvement into electrophotographic printing systems which have already been delivered to customers.

Figure 7:
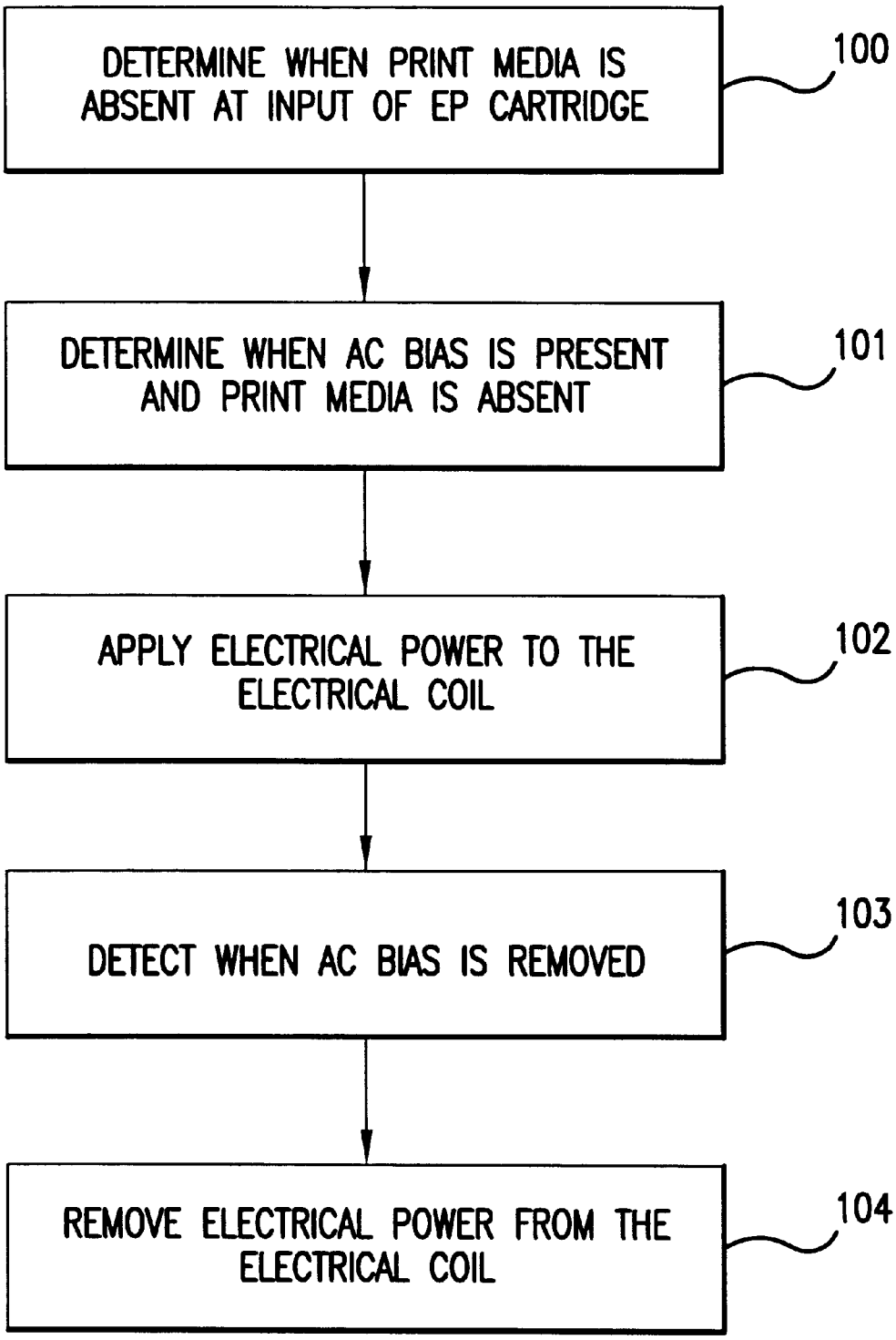
FIG. 7 is a flow chart showing a method for reducing wear on a photoconductor drum.

Shown in FIG. 7 is a method of using the photoconductor wear reduction system to reduce the wear on photoconductor drum 2 in electrophotographic printer 1. The first step involves determining 100 using the photodetector 61*b* in control circuit 60 when print media is no longer present near the print media input side of electrophotographic print cartridge 10. Next, control circuit 60 monitors the AC bias supplied to charge roller 3 to determine 101 the time period for which AC bias is supplied to charge roller 3 and print media is absent from the input side of electrophotographic print cartridge 10. Then, responsive to the operation of control circuit 60, electrical power is applied 102 to electrical coil 32 or 56 to actuate the photoconductor drum clutch 30, thereby mechanically decoupling photoconductor drum 2 from the drive train 24 of electrophotographic printer 1. Next, control circuit 60 detects 103 the condition in which AC bias is no longer supplied to charge roller 3. Finally, control circuit 60 removes 104 electrical power from electrical coil 32 or 56, thereby mechanically coupling photoconductor drum 2 to drive train 24.

Although several embodiments of the invention have been illustrated, and their forms described, it is readily apparent to those of ordinary skill in the art that various modifications may be made therein without departing from the spirit of the invention or from the scope of the appended claims.

What is claimed is:

1. A photoconductor wear reduction system for use in an electrophotographic printing system for printing on media, comprising:

a photoconductor;

a clutch attached to the photoconductor; and a control circuit coupled to the clutch and the electrophotographic printing system, with the control circuit configured to actuate the clutch to selectively stop application of mechanical power to the photoconductor after the media moves past the photoconductor.

2. The photoconductor wear reduction system as recited in claim 1, wherein:

the clutch includes a configuration to stop the application of the mechanical power to the photoconductor upon stopping application of electric power to the clutch; and the clutch includes a configuration to apply the mechanical power to the photoconductor upon the application of the electric power to the clutch.

3. The photoconductor wear reduction system as recited in claim 1, wherein:

the clutch includes a configuration to stop the application of the mechanical power to the photoconductor upon application of electric power to the clutch; and the clutch includes a configuration to apply the mechanical power to the photoconductor upon stopping the application of the electric power to the clutch.

4. The photoconductor wear reduction system as recited in claim 3, wherein:

the electrophotographic printing system includes a drive train, with the clutch including a configuration for mechanical coupling of the photoconductor to the drive train and for mechanical decoupling of the photoconductor from the drive train.

5. The photoconductor wear reduction system as recited in claim 4, wherein:

the photoconductor includes a photoconductor drum.

6. The photoconductor wear reduction system as recited in claim 5, wherein:

the control circuit includes a photodetector for detecting the presence of the media adjacent to the photoconductor drum.

7. The photoconductor wear reduction system as recited in claim 6, wherein:

the actuation of the clutch by the control circuit for the mechanical decoupling of the photoconductor drum from the drive train occurs responsive to a first signal from the photodetector and a second signal from the electrophotographic printing system coupled to the control circuit.

8. The photoconductor wear reduction system as recited in claim 7, wherein:

the actuation of the clutch by the control circuit for the mechanical decoupling of the photoconductor drum from the drive train occurs after the first signal indicates the absence of the media and while the second signal indicates the presence of an AC bias from the electrophotographic printing system.

9. An electrophotographic printing system for printing on media, comprising:

a photoconductor;

a clutch attached to the photoconductor;

a control circuit coupled to the clutch and the electrophotographic printing system; and a drive train, with the control circuit configured to actuate the clutch to selectively mechanically decouple the photoconductor from the drive train after the media moves past the photoconductor.

10. The electrophotographic printing system as recited in claim 9, wherein:

the clutch includes a configuration to mechanically decouple the photoconductor from the drive train upon stopping application of electric power to the clutch; and the clutch includes a configuration to mechanically couple the photoconductor to the drive train upon the application of the electric power to the clutch.

11. The electrophotographic printing system as recited in claim 9, wherein:

the clutch includes a configuration to mechanically decouple the photoconductor from the drive train upon application of electric power to the clutch; and the clutch includes a configuration to mechanically couple the photoconductor to the drive train upon stopping the application of the electric power to the clutch.

12. The electrophotographic printing system as recited in claim 11, wherein:

the photoconductor includes a photoconductor drum.

13. The photoconductor wear reduction system as recited in claim 12, wherein:

the control circuit includes a photodetector for detecting the presence of the media adjacent to the photoconductor drum.

14. The photoconductor wear reduction system as recited in claim 13, wherein:

the actuation of the clutch by the control circuit for the mechanical decoupling of the photoconductor drum from the drive train occurs responsive to a first signal from the photodetector and a second signal from the electrophotographic printing system coupled to the control circuit.

15. The photoconductor wear reduction system as recited in claim 14, wherein:

the actuation of the clutch by the control circuit for the mechanical decoupling of the photoconductor drum from the drive train occurs after the first signal indicates the absence of the media and while the second signal indicates the presence of an AC bias from the electrophotographic printing system.

16. In an electrophotographic printing system for printing upon print media with the electrophotographic printing system including a photoconductor, a clutch attached to the photoconductor, a drive train, and a control circuit coupled to the clutch, a method for reducing wear on the photoconductor, comprising the steps of:

determining when the last unit of print media in a print job has passed the photoconductor using the control circuit with the step of determining including detecting the absence of print media and detecting the presence of an AC bias supplied by the electrophotographic printing system; and decoupling the photoconductor from the drive train by actuating the clutch.

17. The method as recited in claim 16, wherein:

the step of decoupling includes actuating the clutch by the application of electrical power responsive to the control circuit.

18. The method as recited in claim 17, further comprising the step of:

coupling the photoconductor to the drive train by removing electrical power responsive to the control circuit.

* * * * *